United States Patent [19]

Nagata et al.

[11] 4,368,219

[45] Jan. 11, 1983

[54] METHOD AND APPARATUS FOR COATING THE INNER SURFACE OF LONG TUBES OF SMALL DIAMETER

[75] Inventors: Koji Nagata; Kyuji Sudo; Mamoru Nishikawa; Kikuji Tachibana, all of Nagoya, Japan

[73] Assignee: Sumitomo Light Metal Industries Ltd., Tokyo, Japan

[21] Appl. No.: 246,220

[22] Filed: Mar. 23, 1981

[30] Foreign Application Priority Data

Jun. 13, 1980 [JP] Japan ..... 55-80674
Jul. 4, 1980 [JP] Japan ..... 55-91913

[51] Int. Cl.[3] ..... B05D 1/02

[52] U.S. Cl. ..... 427/236; 427/233; 427/421; 118/306; 118/DIG. 10; 222/571; 239/106

[58] Field of Search ..... 118/306, 317, 318, DIG. 10; 427/233, 236, 421; 222/571; 239/106

[56] References Cited

U.S. PATENT DOCUMENTS 2,074,935 3/1937 Potthoff ..... 118/318 X
2,501,779 3/1950 Loudenback et al. ..... 118/DIG. 10
3,085,549 4/1963 Kacsuta ..... 118/317
3,606,862 9/1971 Huff et al. ..... 118/DIG. 10
4,272,021 6/1981 Standal ..... 239/106

*Primary Examiner*—Shrive P. Beck
*Attorney, Agent, or Firm*—Browdy and Neimark

[57] ABSTRACT

A method and apparatus for coating a long tube of small diameter by means of inserting a supplying hose of double structure, with a spray nozzle ahead and two separately extending inner and outer hoses for supplying paint and compressed air respectively therethrough, into the long tube from one end opening thereof toward the other end opening thereof, and retracting the spray nozzle, when it has reached the destination, while spraying the paint at a predetermined speed. The inner hose for the paint is made of flexible material as an elastic hose for being compressive in the diametrical direction under the pressure from the compressed air in the outer hose and again restorable to the original shape when the pressure is released. This supplying hose can be fed out from and wound up on a drum of a winding up mechanism regularly and automatically, with the aid of a pinching roller mechanism which moves the supplying hose forwardly and backwardly by the rotating force of a pair of pinching rollers under some pressure for preventing the slackening of the same when it is moved in either direction.

12 Claims, 9 Drawing Figures

FIG. 1
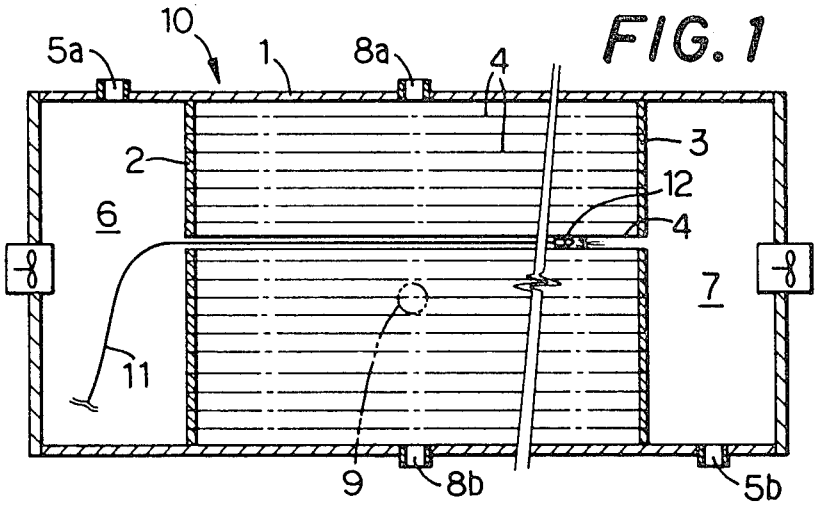
FIG. 3a
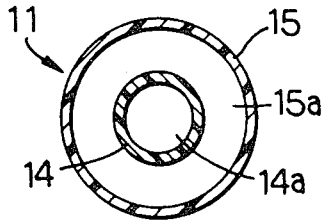
FIG. 3b
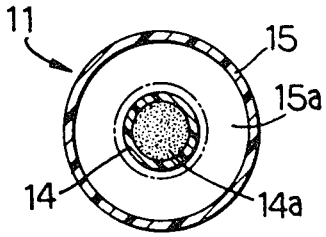
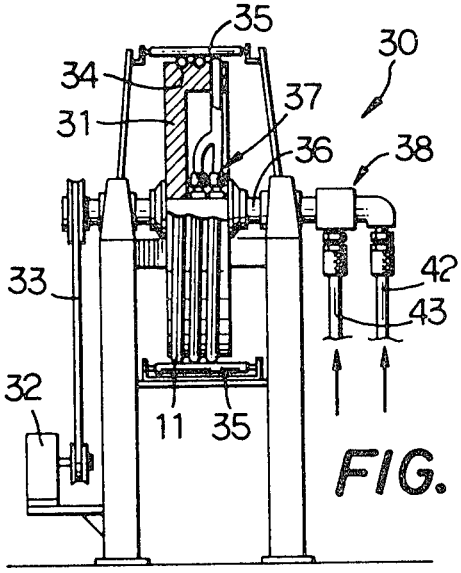
FIG. 6
FIG. 4a
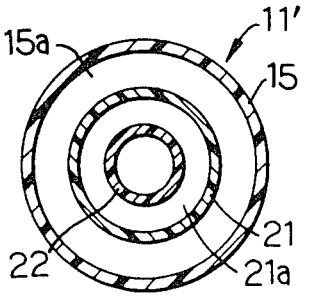
FIG. 4b
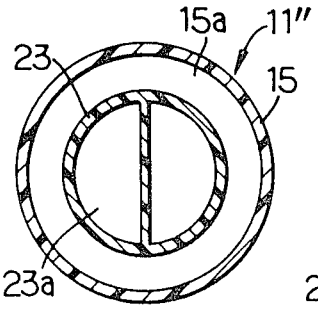
FIG. 4c
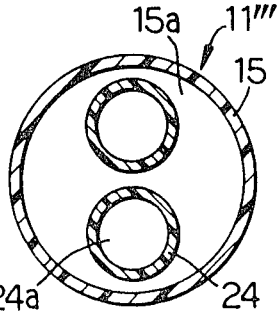

METHOD AND APPARATUS FOR COATING THE INNER SURFACE OF LONG TUBES OF SMALL DIAMETER

FIELD OF THE INVENTION

This invention relates to a method and apparatus for coating the inner surface of long tubes of small diameter, and more particularly to a method and apparatus for effectively applying protective coating on the inner surface of heat exchanger tubes installed in a surface condenser for a steam turbine, in such a specific way that the tubes to be coated are fixed in place in a working plant.

BACKGROUND OF THE INVENTION

In power plants a surface condenser has been conventionally employed to cool and condense a gas (steam) exhausted from a power generating steam turbine for recycling the condensed water. In a condenser of this type thousands of or tens of thousands of copper alloy condenser tubes, having ordinarily an internal diameter of 10–40 mm$\phi$ and a length as long as 5–40 m, are incorporated. Through the condenser tubes flows cooling water such as sea water so as to cool down the exhaust steam (vapor) passing the outside gap of the large number of condenser tubes.

The copper alloy condenser tubes are subjected to various types of corrosion because of fairly high speed flowing of corrosive water such as sea water on the order of 1–2.5 m/s and of the pollution of cooling water, for example, which necessitates coating or painting of the inner surface of the tubes with an anti-corrosive paint of organic resin over the whole length thereof for the purpose of preventing corrosion. However, the coating is strictly conditioned not to greatly inhibit the heat transfer rate of copper alloy tubes. In the case of applying anti-corrosion coating on the inner surface of copper alloy condenser tubes, the thickness of the coated film must be uniform and controlled in the range as small as 10–30$\mu$ from the view point of maintaining the desired heat transfer rate.

The life of coating of this type is inevitably shorter than the life of the power plant itself, which is as long as 20–30 years if the above-mentioned thin coated film is maintained; and the coating is liable to be worn away after the tube is mounted in the plant to expose sometimes the base metal. The coating may be damaged in some cases by mechanical rubbing with shells or sand grains contained in the cooling water, and its wearing may be accelerated by the so-called sponge-ball cleaning carried out to remove mud and/or sea weeds stuck on the inner surface of the tubes. Such being the case, the tubes must be recoated periodically or occassionally to maintain anti-corrosion and anti-rust condition in the plant.

Some of coating methods have been recognized and practiced widely for coating the interior of tubes of relatively small length, for example, flowing paint in a tube or directly brushing paint. Such methods are however utterly impracticable, in the case of coating a long tube of small diameter such as a condenser tube, for obtaining a coated film of uniform thickness there. And particularly in the former method the paint flowed into a tube can not be diffused in the interior of the tube unless the horizontal tubes installed in the condenser are inclined.

As a relatively practical method spray coating can be mentioned, wherein the interior of a tube is coated by a spray gun spraying atomized paint. Even in this method employing a long necked spray gun of 500 mm, a coatable area, or the length of the coated area, covered by means of inserting the gun into the tube is naturally limited (restricted) in the partial length thereof. As a variation of such spray coating, a method of coating, wherein a paint spraying nozzle is moved (retracted) from one end opening of a tube to the other end opening during spraying paint, has been developed and has succeeded in getting a coated film of uniform thickness throughout the whole length of a long tube of small diameter.

There have still been, however, several problems in the spray coating method of this type: it is a matter of course that no spray is allowed while the spray gun is moved through a long tube from one end to the other end before it reaches the destination where spraying is to begin; even a slight leakage of paint from the nozzle in the meantime will hamper the uniform coating of the tube interior; the paint passage must be absolutely tightly closed while it is not in use, otherwise the nozzle will suffer from uneven spraying or no-spraying due to hardening of paint left in the nozzle.

For the elimination of those problems conventional nozzles have employed a stopper of core bar type. In other words, a pointed portion on the tip of the stopper is fitted into an opening portion of the paint passage of a nozzle insert, so that the opening portion of the paint passage is opened and closed by the advancing and retracting of the stopper. Such a type of stopper is liable to abnormally work or in some cases become entirely paralysed, in the event that a tube to be coated is very long, due to unexpected deflection or friction of the stopper.

The inventors of this invention proposed, in JITSU-GAN-SHO-54(1979)-147332 and JITSU-GAN-SHO-54(1979)-147333 (Japan, etc., a method of eliminating the above-mentioned disadvantages by means of closely and tightly covering the paint spraying nozzle by a stopper of a cap shape type. In a nozzle of this type the tip portion thereof is covered by a cap type stopper until it reaches the other end of a tube to be coated. Upon the nozzle reaching the other end of the tube, the cap is removed from the nozzle to allow the paint to be sprayed while the nozzle is being retracted along through the tube inside. This enabled coating of the interior of a long tube. It still leaves, however, something to be desired, such as the necessity of arranging an individual operator on either end of the tube to be coated for the purpose of putting on and removing the cap type stopper, and particularly in the event of coating copper alloy tubes in a condenser at a power station the stopper removed on one side of a condenser must be brought back each time to the other side of a condenser where the nozzle is inserted. It not only provides a great problem of coating efficiency, but also another serious problem of deteriorating the operation environment owing to a remarkable rising of density of the harmful organic solvent, such as toluene, on the stopper removing side at the beginning of paint spraying.

In the spray coating of copper alloy tubes in a condenser there are some unavoidable restriction conditions, especially in the event of coating or re-coating of the already installed tubes in place, from the view point of operation mode, operation environment, or operation term allowed, etc. A first problem of restriction lies in an extremely narrowly limited space for the coating operation; it is often limited in the condenser water box, the dimensions of which are 2–3 m in depth, 2–3 m in width, and 2–5 m in height. In the case of coating tubes in such a restricted space, ordinary operational apparatus, techniques and conditions used in a satisfactorily broad manufacturing plant can not be applied as they are.

A second problem of restriction lies in deterioration of the operational environment, due to gradual pollution of the atmosphere in the condenser water box where the coating operation must be carried out, because the evaporation of thinner (solvent) from the paint in the narrow operation space makes it undesirable to keep the operators staying there for a long time.

A third problem of restriction lies in that the re-coating operation must be finished during the term of inspection of the whole power generating plant, so the term allowed for the operation of re-coating the heat exchanger tubes is relatively short. Even when an established operation mode in an already installed plant may be introduced there, the number of coating apparatuses permitted to be worked in the narrow space is naturally limited. Elongation of the operation term is very inconvenient under such circumstances. A coating method and apparatus of high efficiency has thus been badly looked forward to.

SUMMARY OF THE INVENTION

This invention was made from such a background. The inventors of this invention have reached, after a series of studies and experiments, the completion of the present invention by finding that a spray nozzle can be effectively moved when it is inserted as far as an opposite end of a tube to be coated, without giving rise to a leakage of the paint, or a so-called dripping of the paint from the nozzle portion, by means of adopting a special structure on a supplying hose which delivers paint and compressed air to the spray nozzle, with a result of favorably eliminating the conventional cap-shaped stopper for tightly closing the nozzle portion.

A primary object of this invention is to provide an effective method of coating the inner surface of a long tube of small diameter which allows elimination of a cap type stopper.

Another object of this invention is to provide an effective method of coating the inner surface of a long tube of small diameter which allows coating operation, without a fear of dripping of paint from the nozzle portion, for a large number of tubes in order by means of executing the coating operation only on one end opening side of the tube to be coated.

A further object of this invention is to provide a unique structure of a supplying hose which is capable of preventing the dripping of paint from the nozzle portion, without utilizing the cap type stopper, by means of drawing the paint in the nozzle portion back into the paint passage in the supplying hose upon suspending the paint supplying.

A still other object of this invention is to provide a coating apparatus capable of effectively coating the inner surface of a condenser tube, which is actually installed in a condenser, by eliminating all of the above-mentioned problems.

Other objects of this invention will be apparent for those skilled in the art from the study of specific description of this invention in conjunction with the accompanying drawings.

This invention for achieving the above-mentioned objects is characterized in having a supplying hose, employed in a coating operation wherein a spray nozzle is inserted from one end opening of a long tube to be coated of small diameter deep thereinto as far as the other end opening and retracted while spraying atomized paint toward the firstly inserted end opening, with such a structure that a spray nozzle is attached on the forward end thereof and the hose is of multi-tubing structure, i.e. consisting of a plurality of hoses or tubes, one enveloping others therein, for delivering paint and compressed air through a respective passage to the spray nozzle. For that purpose the supplying hose is provided with an outer hose and at least one inner hose concentrically or eccentrically received in the former so as to form a plurality of passages in the outer hose. And any one of the hoses constituting the multi-tubing structure, which borders the paint passage and the compressed air passage, is an elastic one deformable in the radial direction under some pressure.

The paint passage in the multi-tubing supplying hose is compressed by the action of the supplied compressed air during the paint spraying operation so that its volume is diminished through the reduction of the cross sectional area of the paint passage. When the coating operation is suspended with the release of pressure to the paint and the compressed air, the compressive action against the paint passage is removed and the volume of the paint passage is restored owing to the elasticity of the elastic hose. This volume increase of the elastic hose containing the paint draws back the forward end of the paint in the spray nozzle. This drawing action of the paint applied on the paint in the paint passage owing to a negative pressure effectively and automatically prevents the dripping of the paint from the nozzle which in the prior art was conventionally prevented by the cap type stopper.

In this invention an undermentioned apparatus can be effectively utilized, for the purpose of realizing the above-mentioned coating method, which apparatus is operated by inserting a spray nozzle into a long tube of small diameter from one end opening toward the other end opening and moving the spray nozzle back toward the original end opening thereof while spraying atomized paint so as to uniformly coating the inner surface of the tube. Such apparatus is characteristically provided with a supplying hose of flexible structure, with a spray nozzle ahead, having a paint passage and a separate compressed air passage for respectively supplying paint and compressed air to the spray nozzle, and further provided outside the tube-to-be-coated with a pinching roller mechanism for continuously inserting the supply hose into the long tube-to-be-coated and retracting the same therefrom at a predetermined constant speed and a winding up mechanism from which the supplying hose is fed to the pinching roller mechanism and for winding up (taking up) the supplying hose drawn back from the pinching roller mechanism.

The method and apparatus of this invention can be effectively applicable to the coating of condenser tubes, as a heat exchanger tube, in a surface condenser which is installed in a power plant, etc., irrespective of their being as long as 3–40 m, preferably 5–40 m and having an internal diameter as small as 10–40 mm$\phi$, by virtue of the capability of forming a thin and uniform coating film throughout the whole length thereof which does not affect at all the heat exchanging function thereof.

BRIEF DESCRIPTION OF THE DRAWING

FIG. 1 is an explanatory axial sectional view of a surface condenser wherein the method and apparatus of this invention can be preferably applied;

FIG. 3(*a*) and (*b*) are respectively a cross sectional view of the end portion of the supplying hose shown in FIG. 2 taken along the section line III—III, wherein (a) showing the status while no paint and compressed air being supplied and (b) the status while paint and compressed air being supplied;

FIG. 4(*a*), (*b*), and (*c*) are respectively a view of another structure of the supplying hose employed in this invention in a status corresponding to FIG. 3(*a*);

FIG. 6 is a partial sectional view of FIG. 5 taken along the section line VI—VI.

DETAILED DESCRIPTION OF THE PREFERRED EMBODIMENTS

Figure 2:
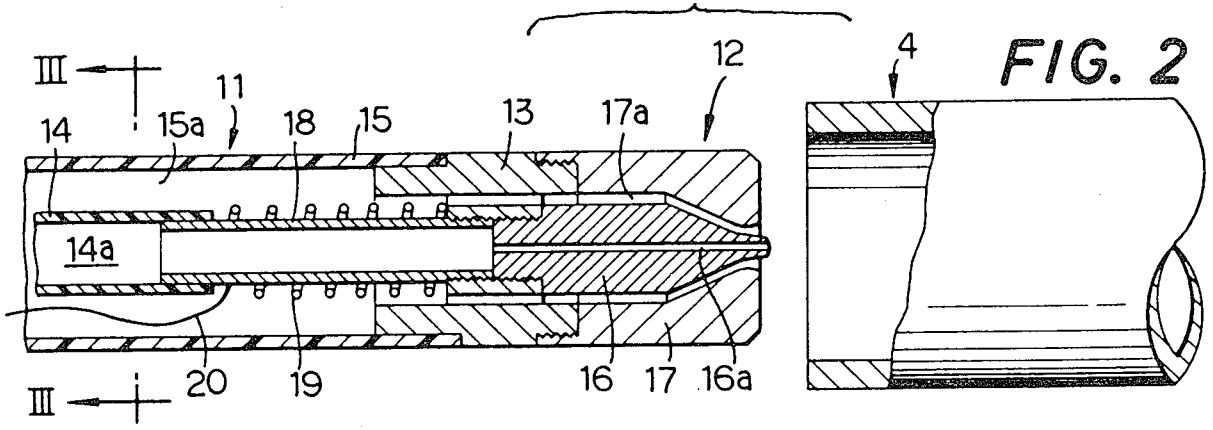
FIG. 2 is an explanatory axial sectional view of an end portion of a supplying hose employed in this invention.

Detailed description of the preferred embodiments will be made hereunder with reference to the appended drawings.

In FIG. 1 an example of a surface condenser (hereinafter called condenser) 10 is shown, which is employed in a power station in connection with a steam turbine. The condenser 10 is constituted of a large fluid tightly sealed cylindrical condenser shell 1, which is divided into three chambers by a pair of condenser tube plates 2 and 3 disposed nearby either end portion thereof. Between the pair of condenser tube plates 2 and 3, in the middle part of the condenser shell 1, thousands of or tens of thousands of cooling tubes (heat exchanger tubes) 4 of copper alloy, with the inner diameter of 10–40 mm$\phi$ and with the length of 3–40 m, specifically 5–40 m, are horizontally installed; and on either outer side of the condenser tube plate 2, 3 a condenser water box 6, 7 is respectively confined.

Almost at the middle portion of the condenser shell 1 a steam inlet port 8*a* is formed on the top thereof in FIG. 1, at the opposite position of the condenser shell 1, on the lower side in FIG. 1, a condensed water recovering part 8*b* is formed, and on the flank of the condenser sheel 1 a vent 9 is formed. As can be seen in FIG. 1 a discharge port 5*a* of the cooling water is in the condenser water box 6 on the left side and an inlet port 5*b* of the cooling water is in the condenser water box 7 on the right side. At the inlet port 5*b* and the discharge port 5*a* of the cooling water are respectively connected a circulating water pump, at the condensed water recovering port 8*b* a condensate pump, and at the vent 9 a gas exhausting pump is connected. They are all, however, not illustrated here. In short, the cooling water flows through, in a condenser 10 of this structure, the cooling tubes (heat exchanger tube) 4 from right to left (in FIG. 1) and cools down to water the exhaust gas (steam) coming from the steam turbine, which passes through the gap of a number of cooling tubes almost vertically, by the heat exchange taking place through contact of the two at the tube wall. The exhausted steam can be condensed to water in this way. In the event of applying protective coating on the inner surface of the cooling tubes in such a condenser 10 a later described supplying hose and a supplying apparatus in accordance with this invention, shown in FIG. 2 and others, are employed.

As shown in FIG. 2, on the tip of a supplying hose 11 which is inserted into and then retracted through a long condenser tube 4 of copper alloy, being incorporated in a condenser used in a power station as mentioned above, a spray nozzle 12 is attached via a coupling (joint) 13. The supplying hose 11 in this first embodiment is of double-tubing structure consisting of an inner tube or hose 14 for supplying paint and an outer tube or hose 15 for supplying compressed air, the latter being of hard nylon and substantially non-deformable in the radial direction under any inner and outer pressure while at the same time making the supplying hose 11 flexible as a whole. On the contrary, the inner hose 14 is of soft or plasticized polyvinyl chloride resin and is deformable in the radial direction under any inner or outer pressure, that is to say, changeable in the dimension of the diameter or the cross sectional area thereof, and being capable of returning to the original shape (original diameter), upon release of the pressure, owing to its own elasticity. In the supplying hose 11 of such double structure, the inside of the inner hose 14 defines a paint passage 14*a*, and the hollow annular space between the inner hose 14 and the outer hose 15 is made into an air passage 15*a* for compressed air.

At one end of the joint 13 which connects the supplying hose 11 and the spray nozzle 12, nearer to the nozzle 12, a nozzle insert 16 having a paint passage 16*a* piercing through the center thereof is concentrically threaded into the joint 13. And a nozzle cap 17 is threaded on the nozzle insert 16 so as to cover the latter for forming a compressed air passage 17*a* in a gap (space) between the nozzle insert 16 and the nozzle cap 17. On the other end of the joint 13, the outer hose 15 of the supplying hose 11 is fitted on, and on one end of a metallic connecting pipe 18, which is threaded in a central through bore of the joint 13, the inner hose 14 for supplying paint is fitted. On the outer surface of the connecting pipe 18 threaded into the joint 13 a sheathed heater 19 is wound thereabout, which is supplied electric power through a lead wire 20 extending along the inside of the outer hose 15 for heating the paint and compressed air to a predetermined temperature. This equipment of the heating system enables the coating apparatus of this embodiment to carry out formation of a non defective coated film of uniform thickness irrespective of coating conditions.

For conducting a coating operation by employing the supplying hose 11 of such structure having the paint passage 14*a* and the compressed air passage 15*a*, the spray nozzle 12 must be inserted ahead into one end opening of a condenser tube 4, and this inserting action is continued until the spray nozzle 12 reaches the other end opening of the long condenser tube 4. Upon reaching the destination the inserting action of the supplying hose 11 is ceased, followed by starting of the paint spraying from the spray nozzle 12. The paint and the compressed air are respectively supplied from an independent paint tank (not shown) and compressed air tank (not shown) through individual routes to the supplying hose 11, where they flow respectively into the paint passage 14*a* and the air passage 15*a* separately and then to the spray nozzle 12. The paint is sprayed by virtue of the blowing (gushing) force of the compressed air, as is well known, into atomized particles. Simultaneously with the start of the paint spraying the supplying hose 11 begins to be retracted through the condenser tube 4 toward the originally inserted end opening. While the supplying hose 11 is steadily retracted along the inside of the condenser tube 4 at a predetermined constant speed, the tube interior is coated with a uniform film throughout the whole length thereof. When the spray nozzle 12 arrives at the original end opening of the insertion, the paint spraying action is ceased, thus completely finishing the interior coating of one condenser tube 4. And a second condenser tube 4 is coated by an identical process to the previous one, repeating the same process one after another until a large number of condenser tubes 4 are wholly coated with paint.

As to the problem of so-called dripping (leakage) of paint, it is said that a transition period from the finishing of coating of one condenser tube 4 to the start of coating on a second condenser tube 4, where the spray nozzle 12 is moved from the former to the latter, is most susceptible or likely to cause it. Employment of the above-mentioned supplying hose 11 according to this invention has completely solved this problem of paint dripping.

More specifically describing, the supplying hose 11 is placed, when the paint and the compressed air are not flowed in the paint passage 14*a* and the compressed air passage 15*a*, under no inner nor outer pressure, both the inner hose 14 and the outer hose 15 being maintained in the state shown in FIG. 3(*a*) or in the inherent shape. When the paint and the compressed air are supplied, for starting the paint spraying, from the spray nozzle 12, under a respectively required pressure, the inner hose 14 is forced to be somewhat deformed by the difference of pressure between the paint and the compressed air. For spraying the paint from the spray nozzle 12 the pressure of the air must naturally be larger than that of the paint, so the inner hose 14 is subjected to the outer pressure from the compressed air which is larger than the inner pressure from the paint, with a result of being compressed to diminish the diameter thereof as shown in FIG. 3 (*b*). Consequently the cross sectional area of the paint passage 14*a* is made smaller accompanied by a decrease of the whole volume of the paint passage 14*a*. The spray coating of paint from the spray nozzle 12 is carried out under such a compressed state of the inner hose 14. When the supplying of the paint and the compressed air is stopped with the finishing of coating of one condenser tube 4, the inner hose 14 is released of any inner (from paint) and outer (from compressed air) pressure and is restored to the original shape due to its elasticity as shown with a one-dot-chain line in FIG. 3 (*b*), which means it is restored to the original state shown in FIG. 3 (*a*). As a result, the cross sectional area of the inner hose 14 is enlarged accompanied by the enlarging of the whole volume of the paint passage 14*a* of the inner hose 14. Consequently the paint passage 16*a* in the spray nozzle 12 and the forward end portion of the paint passage 14*a* leading to the paint passage 16*a* will be evacuated of the paint. So the transition of the spray nozzle 12 from one condenser tube 4 just finished of coating to another condenser tube-to-be-coated now is conducted under such a paint evacuated state, which eliminates the conventional cap type stopper for preventing the dripping of paint from the spray nozzle 12. No dripping of paint from the paint passage 16*a* of the spray nozzle 12 can take place, which allows the insertion of the supplying hose 11 with the spray nozzle ahead into another condenser tube 4, without any fear of paint dripping until the spray nozzle 12 reaches the farthest end opening of the condenser tube to be coated.

The elimination of the cap type stopper fitted on and removed from the spray nozzle 12 according to this invention economizes not only the fitting and removing operation but also the otherwise required worker for this operation on the forward end side of the supplying hose 11. This invention thus contributes to the reduction of the needed worker(s) and further to the improvement of the operational environment, because the forward end side of the supplying hose 11 is largely liable to be polluted with harmful fine particles of the paint and the thinner evaporated therefrom.

The paint to be sprayed must be loaded with a sufficiently large pressure for overcoming the friction loss at the hose wall in the paint passage 14*a* and supplied sufficiently large quantity of the compressed air for obtaining the best atomization condition with an appropriate particle size of the paint to be coated. For providing a particle size of the paint less than 20$\mu$ an air volume of 200–300 l/m is necessary, under a throttling of the paint discharging volume to the greatest possible extent. For that purpose the air pressure must be in general more than 3 Kg/cm$^2$ at the gage pressure, although it depends of course on the nozzle caliber. As to the mutual relation between the paint pressure and the compressed air pressure, the latter ($P_s$) must be naturally larger than the former ($P_l$) for getting an ideal atomization of the paint. And the difference ($P_s - P_l$) of the two is desirably in the range 1–2 Kg/cm$^2$. Too small difference between the two possibly makes the atomization condition non-uniform, and particularly when the difference nears the critical point, $P_s \leqq P_l$, the problem of paint dripping will arise, and too large difference ($P_s - P_l$) between the two may cause a shortage of paint, another problem.

The supplying hose 11 employed in this invention is by no means limited to the disclosed embodiment. Many variations and improvements may be made by those skilled in the art by their knowledge without departing from the spirit of the invention. For example, the use of the inner hose 14 as the paint passage 14*a* and the outer hose 15 as the compressed air passage 15*a* may be completely reversed so that the inner hose 14 is used for the compressed air passage 14*a* and the outer hose 15 for the paint passage 15*a*. In that case the inner hose 14 can be, when the compressed air is flowed therein, expanded radially outwardly, to squeeze the paint passage 15*a* in the outer hose 15 for reducing the paint containing capacity. When the air pressure is released, the inner hose 14 may be reduced in its original diameter, returning to the original shape owing to its own elasticity. Consequently the paint passage 15*a* in the outer hose 15 is allowed to be restored to the original volume. It can produce the identical effect to the previous embodiment.

Instead of the double hose structure in the previous embodiment, a triple structure supplying hose 11', another hose 11'' in which the inner hose is divided into two parts by a partition, or still another hose 11''' in which a plurality of inner hoses are eccentrically (non-concentrically) installed in an outer hose, as shown in FIG. 4 (*a*), (*b*), and (*c*), are permissible. In those variations, an example of a triple structure supplying hose 11' shown in FIG. 4 (*a*) is suitable for flowing the compressed air in the passage 15*a* formed by the outer hose 15 of hard (rigid) material. In that case a middle hose 21 should be made of a flexible material for flowing the paint in the inside passage 21*a* thereof. And the innermost hose 22 is desired to be of hard material as the outer hose 15. If in one of the partitioned passage 23*a* of the inner hose 23, shown in FIG. 4 (*b*) the paint is flowed, the inner hose 23 should be made of a soft (flexible) material for being subjected to the compressive force of the compressed air flowed in the passage 15*a* of the outer hose 15 of hard material. In a case shown in FIG. 4 (*c*) wherein the passage in one of the inner hoses 24 is flowed the paint and the passage 15*a* of the outer hose 15 is used for the flowing of the compressed air, the inner hose 24 should be made of a flexible material, just like in the above examples. In those examples, other passages not used for the paint and the compressed air may be utilized as a passage for heating medium for heating the paint and/or the compressed air. More detailed description in this regard may be available in the U.S. patent application filed by the inventors of this invention in the Ser. No. 183,714.

The supplying hose of this invention can take a variety of shapes, so long as it is of multiple structure, one enveloping others, and one hose bordering the paint passage and the compressed air passage (inner hose) is elastic deformable either inwardly or outwardly in the radial direction.

Furthermore, as to the material for the inner hose, a suitable one may be chosen out of the synthetic resin materials, without departing from the spirit of this invention, such that the paint passage may be compressed by being desirably deformed under an influence of the air pressure. The outer hose may be, not being limited only to a synthetic resin one, a metal flexible hose.

Figure 5:
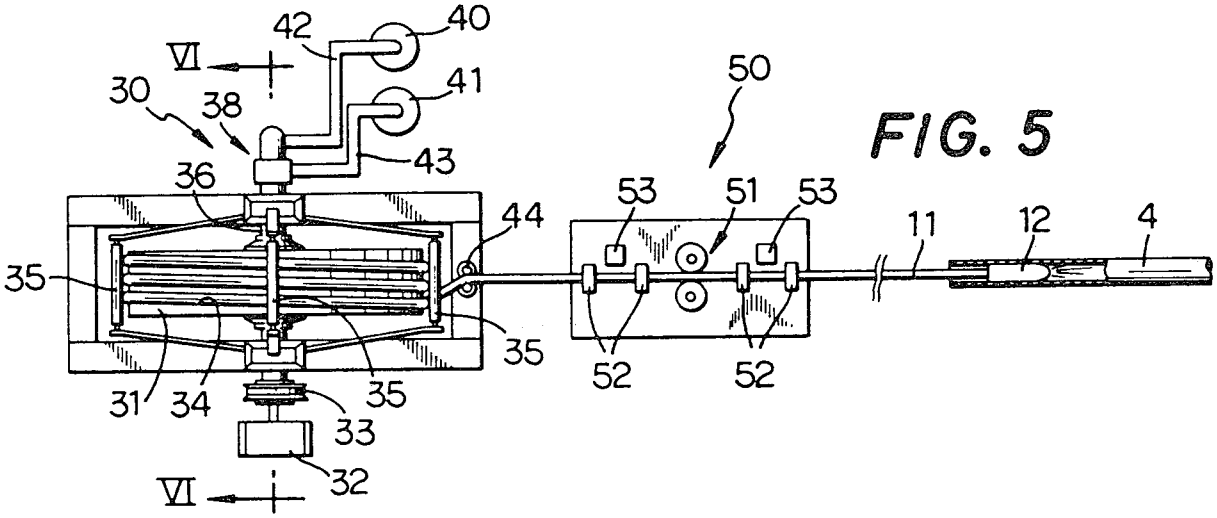
FIG. 5 is a schematic plan view of an example of apparatus employed in this invention.

The supplying hose of this invention, which has been described in greater detail in the above, can be desirably utilized by being inserted into a long tube to be coated of small diameter with the aid of a later described apparatus for coating the inner surface thereof. Specifically speaking, an apparatus according to this invention, shown in FIGS. 5 and 6, will be placed for example in either one of the condenser water boxes 6 and 7 located on opposite end of the condenser 10. The apparatus illustrated in FIGS. 5 and 6 is provided with, for mechanically inserting the supplying hose 11 with the spray nozzle 12 ahead into a condenser tube 4 and retracting (pulling back) the same therefrom, a winding up or rolling up mechanism 30 and a pinching roller mechanism 50. The winding up mechanism 30 has a large winding drum 31, for example with a diameter of 500–1500 mm, enough for taking up the long supplying hose 11, which should be longer than a condenser tube to be coated 4. The winding drum 31 is rotated by a drive motor 32 via a belt 33 for taking up the supplying hose 11 thereabout along a guide groove 34 formed on the periphery of the winding drum 31. The supplying hose 11 can be tightly, without being slackened, wound up on the periphery of the winding drum 31 with the aid of four pressing rolls 35 which are arranged with a phase difference of 90° from each other. And the rear end, or the wind beginning end, of the supplying hose 11 is connected with a known joint 37 to a rotary shaft 36 or a winding shaft. The paint and the compressed air are led from a paint tank 40 and an air tank 41 through a pipe 42 for the paint and a pipe 43 for the air to a respective route extending through the rotary shaft 36 by way of a known rotary joint 38. The paint and the compressed air thus led to the respective route in the rotary shaft 36 are delivered to the paint passage 14 and the compressed air passage 15, in the supplying hose 11 through the joint 37. Numeral 44 designates a guide for guiding the supplying hose 11 when wound up on the winding drum 31 or released therefrom. Besides, the winding up mechanism 30 is of a structure easily put together and dismantled for the convenience of installing it in the condenser water box 6 or 7.

The pinching roller mechanism 50 has a pair of pinching rollers 51 for moving the supplying hose 11 by rotating mutually opposite direction while pinching the supplying hose 11 under some pressure therebetween. The pinching rollers 51 are rotated forwardly and backwardly by a driving means such as an air motor or an electric motor while pressing the supplying hose 11 sufficiently strongly for inserting the same into a condenser tube 4 or pulling back therefrom. On the forward and rear sides of the pinching rollers 51 a pair of guides 52 are disposed for guiding the supplying hose 11. Furthermore, a sensor 53 disposed on opposite side of the pinching rollers 51 is for detecting a slackening of the supplying hose 11 or other troubles.

For carrying out the coating operation with an apparatus of such structure, the supplying hose 11 is released from the winding up mechanism 30 by means of the rotation of the pinching rollers 51 for being inserted with the spray nozzle ahead into one end opening of a condenser tube 4 which is open in one condenser water box 6. The supplying hose 11 provided with the paint passage 14 and the compressed air passage 15 is continuously inserted deeper and deeper into the long condenser tube 4 of 5–40 m until the spray nozzle 12 reaches the other end of the condenser tube 4 where the same is open in the other condenser water box 7. Upon reaching of the spray nozzle 12 the destination the inserting operation of the supplying hose 11 by the action of the pinching rollers 51 is ceased and spraying of the paint from the spray nozzle 12 is started. As to the delivery of the paint and the compressed air to the spray nozzle 12, they are led respectively from the paint tank 40 and the air tank 41, through an independent route, to the respective passage in the supplying hose 11, by way of the rotary joint 38, the rotary shaft 36 of the drum, and the rotary joint 37. At the spray nozzle 12 the paint is sprayed in atomization by the gushing force of the compressed air, as is well known. Simultaneously with the commencement of the paint spraying the supplying hose 11 begins to be retracted by the backward rotating of the pinching rollers. The supplying hose 11 is pulled back at a predetermined speed from the condenser water box 7 toward the condenser water box 6. While the supplying hose 11 is thus retracted from the forward end opening of a condenser tube 4 on the side of the condenser water box 7 to the originally started end opening of the same on the side of the condenser water box 6 the whole length of the condenser tube 4 is coated. When the spray nozzle 12 reaches the original end opening on the condenser water box 6 spraying of the paint with the compressed air is stopped followed by the ceasing of the backward rotation of the pinching rollers. Finishing of coating of one condenser tube 4 in this way is followed by starting of another condenser tube 4 in an identical manner. The same process is repeated until all of the large number of condenser tubes 4 in a condenser are completely coated.

By means of employing the coating apparatus in accordance with this invention, the insertion of the supplying hose 11 into and retraction of the same from the condenser tube 4 are all carried out mechanically, the handling of the supplying hose 11 which should be longer than the long condenser tube 4 to be coated is remarkably simplified, and the apparatus itself could be made compact. Installment of the apparatus in the condenser water box has become very easy, contributing a lot to the improvement of the operation efficiency. As the apparatus of this invention has enabled the insertion of the supplying hose 11 into the condenser tube 4 to be done from one condenser water box for example 6 only, it contributed largely to a conspicuous reduction of the number of workers otherwise needed to be placed on the other side, and consequently to an improvement of the controversial environmental pollution through the manless operation on the inherently subjected side, that is the condenser water box 7, to the thinner, the paint particles, and other harmful substances. It has been actually proved that coating operation with the apparatus of this embodiment on 1500 condenser tubes 4 with the length of 15 meter can be executed by two workers at the rate of 30 tubes per hour. As described above in greater detail this invention has achieved a great improvement of efficiency in the coating operation, a reduction of workers by a large margin, a reduction of operation time, and the betterment of the operation environment. The supplying hose 11 can be well adapted to be moved by the pinching roller mechanism 50 mechanically and effectively because of its material feature of sufficient flexibility. For achieving the effective movement of the supplying hose 11 by the rotation of the pinching rollers, minimizing the idle sliding between the supplying hose and the pinching rollers, appropriate choice of the material for both, and the pressing force of the pinching rollers, etc., must be paid great attention. As the material for the rollers (51) any one is desired to be selected from the group consisting of nylon, polyethylene, hard or unplasticized polyvinyl chloride, polytetrafluoroethylene, polypropylene, silicone, etc. And as the material for the supplying hose 11, it is necessary that the outer hose has good mechanical properties and the inner hose contacted with paint has soft hardness and high resistance against solvent. As the material for the outer hose 15 thereof, any one selected from the group consisting of hard nylon, hard or unplasticized polyvinyl chloride, bridge polyethylene, polypropylene, polyurethane, silicone, etc. is preferable. The supplying hose 11 is desired, as a result of such a choice made to the determination of the material features, to be freely flexible. Besides, the supplying hose 11 must be, for being inserted in a long condenser tube 4, selected from a material provided with a modulus of tensile elasticity 500–3,000 $Kg/cm^2$, surface rigidity or hardness (Rockwell hardness: R) not less than 50, compressive strength not less than 150 $Kg/cm^2$, and breaking elongation strength not less than 100% preferably not less than 150% as the material features thereof. The material features of those members are, when the paint and the compressed air are supplied under heating as described later, more strictly conditioned such that they should not be substantially affected under the temperature level of 60° C. in general. Furthermore, for the purpose of reducing the driving force of the drive motor (not shown) for rotating the pinching rollers 51 and reducing the wear of the outer surface of the supplying hose 11 the friction between the inner surface of the condenser tube 4 and the outer surface of the supplying hose 11 is desired to be minimized. In case of particular arising of the friction problem, fitting of short cylindrical pipes on the outer surface of the supplying hose 11 with a suitable interval can be recommended.

This invention should not be interpreted by any means as being limited to the above-mentioned method and apparatus. Many variations, modifications and improvements can be made for those skilled in the art within the spirit and scope of this invention. As to the paint to be used for this invention, various kinds can be selected to the coating of, for example, a condenser tube in a surface condenser according to the purposes of coating. For the protective coating, in particular, oily organic synthetic resin coating paint is preferably used, which has as its vehicle an organic solvent solution of any synthetic resin such as alkyd resin, vinyl chloride resin, polyurethane resin, epoxy resin, silicon resin, acrylic resin, etc.

What is claimed is:

1. In a method of coating the inner surface of a long tube of a small diameter, which comprises initially threading a spray nozzle through said tube from a first open end thereof until said spray nozzle reaches a second open end, and withdrawing said spray nozzle toward said first open end while spraying paint therefrom onto said inner surface, wherein the improvement comprises:

delivering said paint and pressurized air to said spray nozzle through respective passages of a plurality of mutually independent axial passages defined by a relatively non-elastic outer tube and at least one inner tube concentrically or eccentrically received within said outer tube whereby one said at least one inner tube is interposed between a paint conveying axial passage and a pressurized air conveying passage, said at least one inner tube and said outer tube constituting in combination a multi-tubing supplying hose connected at one end thereof to said spray nozzle, said pressurized air being at an operating pressure greater than that of said paint, one of said at least one inner tube which is interposed between a paint conveying passage and a pressurized air conveying passage of said plurality of axial passages being less rigid than said outer tube and made of elastic material whereby under operating conditions of said supplying hose said paint conveying passage is radially contracted into a smaller volume due to elastic deformation of said elastic material; and upon termination of delivery of said pressurized air, drawing said paint out of said spray nozzle by means of expansion of said paint conveying passage into an original larger volume, thereby preventing said paint from dripping from said spray nozzle.

2. A method as claimed in claim 1, wherein said multi-tubing supplying hose is of double-tubing structure, consisting of an outer tube of rigid material which is substantially not radially elastically yieldable, and an inner tube of soft material which is radially elastically yieldable, and one of said outer or inner tubes surrounds said paint conveying passage and the other surrounds said pressurized air conveying passage.

3. A method as claimed in claim 1 or 2, wherein a difference in said operating pressure between said paint and said pressurized air within said paint and pressurized air conveying passages, is in the range of 1–2 $kg/cm^2$.

4. A method as claimed in claim 1, wherein said long tube to be coated has an internal diameter in the range of 10–40 millimeters and a length in the range of 3–40 meters.

5. A method as claimed in claim 1, wherein said long tube to be coated is a condenser tube installed in a surface condenser.

6. In an apparatus for coating the inner surface of a heat exchanger tube in a condenser, which comprises means for initially threading a spray nozzle through said heat exchanger tube from one open end thereof until said spray nozzle reaches the other open end, and for withdrawing said spray nozzle toward said one open end while spraying paint therefrom onto said inner surface, wherein the improvement comprises:

a multi-tubing supplying hose which is connected at one end thereof to said spray nozzle to deliver said paint and pressurized air to said spray nozzle, and which comprises a relatively non-radially elastic outer tube and at least one inner tube concentrically or eccentrically received within said outer tube; said at least one inner tube and said outer tube defining a plurality of mutually independent axial passages with one of said at least one inner tube disposed therebetween; means to provide an operating pressure of said pressurized air greater than that of said paint, said one of said at least one inner tube which is interposed between a paint conveying passage and a pressurized air conveying passage of said plurality of axial passages being less rigid than said outer tube and made of elastic material whereby, under operating conditions of said supplying hose, said paint conveying passage is radially contracted into a smaller volume due to elastic deformation of said elastic material, and upon termination of delivery of said pressurized air, said paint conveying passage is radially expanded into an original larger volume thereby preventing said paint from dripping from said spray nozzle; and feeding means for feeding said supplying hose into said heat exchanger tube and withdrawing the same at a predetermined speed.

7. An apparatus according to claim 6, wherein said feeding means comprises a pinch roller mechanism, and further comprising a take-up mechanism for feeding said supplying hose to said pinch roller mechanism and winding up said supplying hose withdrawn by said pinch roller mechanism.

8. An apparatus as claimed in claim 6, wherein said supplying hose is of double-tubing structure, and said outer tube surrounds said pressurized air conveying passage and said one of said at least one inner tube surrounds said paint conveying passage.

9. An apparatus as claimed in claim 6, wherein at least said outer tube is a flexible tube made of plastic material having modulas of tensile elasticity in the range of 5000–30000 kg/cm$^2$, surface hardness not less than Rockwell 50, compressive strength not less than 150 kg/cm$^2$, and breaking elongation not less than 100%.

10. An apparatus as claimed in claim 8, wherein said outer tube is a metallic flexible tube.

11. An apparatus as claimed in claim 7, wherein said take-up mechanism includes a rotary shaft, and the other end of said supplying hose opposite to said one end connected to said spray nozzle is connected to a paint tank and a pressurized air tank via said rotary shaft to supply said paint and said pressurized air to said paint and pressurized air conveying passages, respectively.

12. An apparatus as claimed in claim 6, wherein said heat exchanger tube to be coated has an internal diameter in the range of 10–40 millimeters and a length in the range of 3–40 meters.

* * * * *